US008720695B2

(12) United States Patent
Greve et al.

(10) Patent No.: US 8,720,695 B2
(45) Date of Patent: May 13, 2014

(54) GRADER WITH FEED TROUGH

(75) Inventors: Christopher G. Greve, Covington, LA (US); Robert S. Lapeyre, New Orleans, LA (US)

(73) Assignee: Laitram, L.L.C., Harahan, LA (US)

( * ) Notice: Subject to any disclaimer, the term of this patent is extended or adjusted under 35 U.S.C. 154(b) by 164 days.

(21) Appl. No.: 13/342,266

(22) Filed: Jan. 3, 2012

(65) Prior Publication Data

US 2012/0193272 A1 Aug. 2, 2012

Related U.S. Application Data

(60) Provisional application No. 61/438,048, filed on Jan. 31, 2011.

(51) Int. Cl.
*B07B 1/00* (2006.01)
*B07B 13/16* (2006.01)

(52) U.S. Cl.
CPC ..... *B07B 13/16* (2013.01)
USPC ..... 209/245; 209/240; 209/364; 209/369

(58) Field of Classification Search
USPC ..... 209/240, 245, 309, 364, 369, 920; 452/182, 184
See application file for complete search history.

(56) References Cited

U.S. PATENT DOCUMENTS

| | | | | |
|---|---|---|---|---|
| 282,719 | A | | 8/1883 | Gunckel |
| 490,274 | A | | 1/1893 | Doolittle |
| 820,775 | A | | 5/1906 | Frisby |
| 853,066 | A | | 5/1907 | Crellin |
| 891,225 | A | | 6/1908 | Anderson |
| 916,647 | A | | 3/1909 | Anderson |
| 1,025,791 | A | | 5/1912 | Donges |
| 1,461,265 | A | | 5/1923 | Bullard |
| 1,811,991 | A | | 6/1931 | Bates |
| 2,425,478 | A | | 8/1947 | Lawton et al. |
| 2,728,455 | A | | 12/1955 | Greiner |
| 3,108,691 | A | | 10/1963 | Vance |
| 3,784,007 | A | * | 1/1974 | Skrmetta ..... 209/674 |

(Continued)

FOREIGN PATENT DOCUMENTS

| | | | |
|---|---|---|---|
| CH | 599811 | A5 | 5/1978 |
| DE | 3116699 | A1 | 11/1982 |

(Continued)

OTHER PUBLICATIONS

"Axial roller grader" data sheet, Cabinplant A/S, Haarby, DK, http://www.cabinplant.com/fileadmin/user_upload/downloads/Product_sheets/Axial_roller_grader_1051.pdf, created on Dec. 21, 2010.*

(Continued)

*Primary Examiner* — Gerald McClain
(74) *Attorney, Agent, or Firm* — James T. Cronvich

(57) ABSTRACT

A roller-type grader having adjustable, widening gauging passages between consecutive rotating grader rollers and an associated method for adjusting the gauging passages. A drive rotates all the rollers in the same direction on their axes. The ends of the rollers at each end are rotatably and pivotally suspended from adjustment yokes that are movable laterally in unison along tracks by an adjustment shaft. Positioning the yokes positions the ends of the rollers relative to each other. Minimum and maximum widths of the gauging passages at opposite ends of the rollers are adjusted by rotating the adjustment shafts.

14 Claims, 6 Drawing Sheets

(56) References Cited

U.S. PATENT DOCUMENTS

| | | | | |
|---|---|---|---|---|
| 4,172,527 | A | 10/1979 | Bost | |
| 4,723,660 | A | 2/1988 | Sjoberg | |
| 4,979,624 | A | 12/1990 | Ellis | |
| 5,413,226 | A | 5/1995 | Matthews | |
| 5,467,700 | A | 11/1995 | Dowell | |
| 5,893,465 | A | 4/1999 | Harangozo | |
| 6,264,043 | B1 | 7/2001 | Mobley | |
| 7,581,648 | B2 | 9/2009 | Greenbank | |
| 7,810,648 | B2 * | 10/2010 | Takev et al. | 209/364 |
| 7,861,845 | B1 | 1/2011 | Lapointe | |
| 8,191,714 | B2 | 6/2012 | Kalvenkamp | |
| 2007/0000823 | A1 | 1/2007 | Greenbank et al. | |
| 2010/0108575 | A1 * | 5/2010 | Vecchiato | 209/309 |
| 2012/0131894 | A1 | 5/2012 | Pellenc et al. | |

FOREIGN PATENT DOCUMENTS

| | | | |
|---|---|---|---|
| EP | 0562692 | A1 | 9/1993 |
| FR | 1284572 | A | 2/1962 |
| GB | 392295 | A | 5/1933 |
| NL | 1031590 | C2 | 6/2007 |

OTHER PUBLICATIONS

"Fish Grading Machines KM.231 & KM.232," data sheet, K.M. Fish Machinery A/S, Dybvad, DK.

"Roller Grader" brochure, PATKOL Public Company Limited, Rachathewa, TH.

"Axial roller grader" data sheet, Cabinplant A/S, Haarby, DK.

"Onshore Seafood Processing" brochure on CT 1018, Carnitech A/S, Stovring, DK.

Partial International Search Report, PCT/US12/20019, Mar. 26, 2012, European Patent Office, Rijswijk, NL.

International Search Report and Written Opinion of the ISA/EP, PCT/US12/20019, May 7, 2012, European Patent Office, Rijswijk, NL.

* cited by examiner

GRADER WITH FEED TROUGH

CROSS-REFERENCE TO RELATED APPLICATIONS

This application claims the priority of U.S. Provisional Patent Application No. 61/438,048, "Grader," filed Jan. 31, 2011, and incorporated entirely by reference into this application.

BACKGROUND

The invention relates generally to apparatus and methods for grading or sorting solid objects and more particularly to grading apparatus having a gauging passage between rotating rollers.

Roller graders are used to sort solid objects into different sizes, or grades. Solid objects that are graded include food products, such as fruits, vegetables, nuts, shellfish, portions of meat, poultry, and fish, and non-food products, such as ball bearings, castings, and aggregates. One kind of grader often used comprises pairs of rotating rollers separated by a gauging passage, or grading gap, that increases in width along the lengths of the rollers. A product to be graded, held in the gap by gravity, advances along the lengths of the rollers and falls through the rollers at the position along the length at which the gap widens enough. To prevent the rollers from squeezing the products through the gaps prematurely, the rollers of each pair are rotated about their axes in opposite directions so that the peripheries of both rollers move upward at the gap. In a grader having a planar array of pairs of peeling rollers counter-rotating as described, consecutive rollers rotate in opposite directions across the width of the grader. This means that the right-most roller of the pair and the left-most roller of an adjacent pair, which are separated by a space, both rotate so that their outer peripheries move downward at the space. This downward motion of both rollers prevents the intervening space from being used as a gauging passage. For a grader having, for example, ten rollers (arranged in five pairs) separated by nine spaces, only five gauging passages are formed. Thus, because only a small portion of the potential grading area is available for grading, throughput is limited.

SUMMARY

This shortcoming is overcome by a grader embodying features of the invention. One version of such a grader comprises a grading section that extends in length from an infeed end to an opposite end and in width from a first side to a second side. The grading section includes a plurality of rollers whose axes of rotation are directed from the infeed end to the opposite end.

The rollers are spaced apart laterally across the width of the grading section to define gauging passages extending along the length of the grading section between laterally consecutive rollers. The grader further comprises a passage-width adjustment mechanism coupled to the rollers at one of the infeed and opposite ends to adjust the width of the gauging passages between the rollers in unison. A drive system coupled to the rollers rotates them all in the same direction on their axes.

Another aspect of the invention comprises a method for adjusting the gauging passages between consecutive grading rollers of a grader used for grading products that advance along the lengths of the rollers from an infeed end to an opposite end. The method comprises translating first ends of the rollers laterally in unison to change the width of all the gauging passages at the first ends at the same rate.

BRIEF DESCRIPTION OF THE DRAWINGS

These features and aspects of the invention, as well as its advantages, are described in more detail in the following description, appended claims, and accompanying drawings, in which:

DETAILED DESCRIPTION

Figure 1:
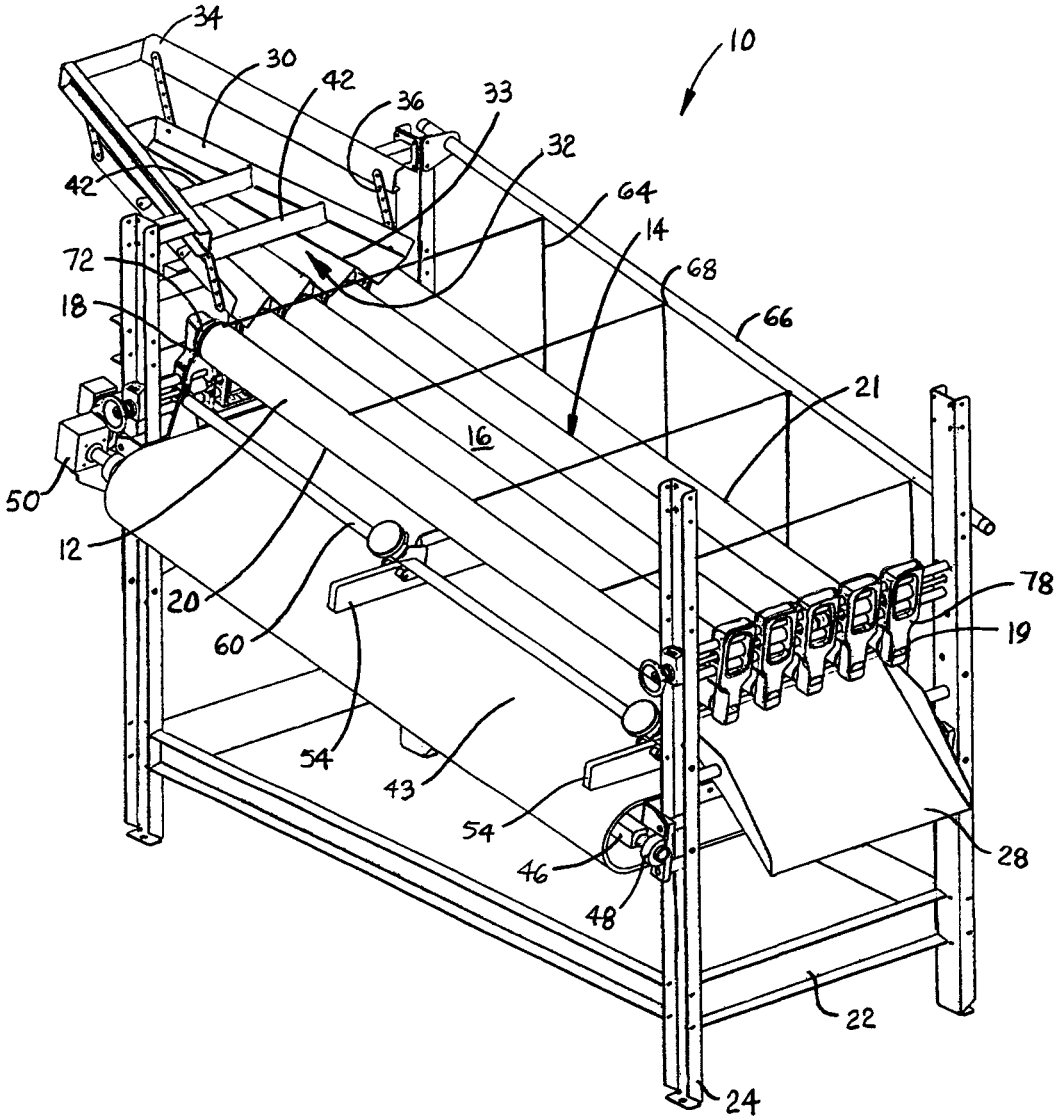
FIG. 1 is an axonometric view of one version of a grader embodying features of the invention viewed from the exit end.
Figure 2:
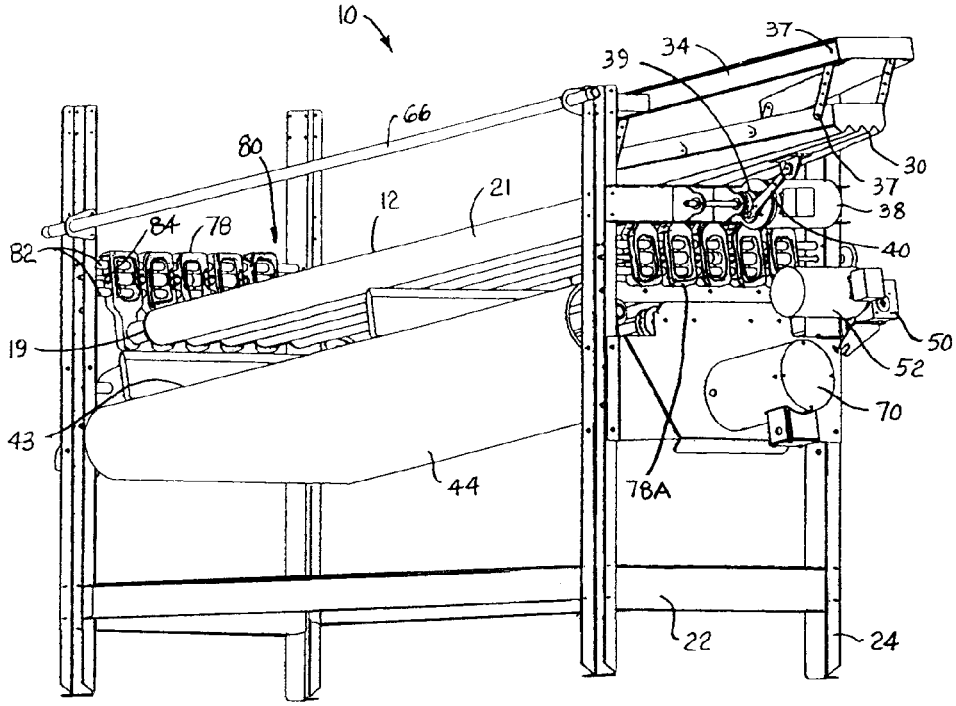
FIG. 2 is an isometric view of the grader of FIG. 1 viewed from the infeed end.
Figure 3:
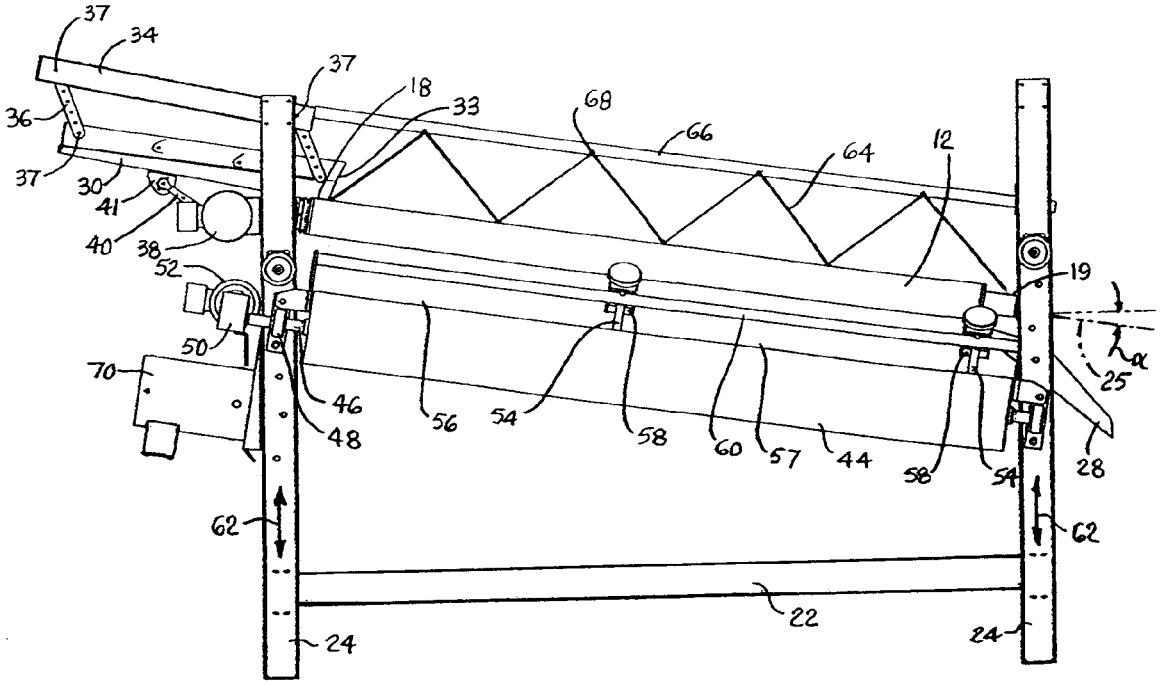
FIG. 3 is a side elevation view of the grader of FIG. 1.

One version of a grader embodying features of the invention is shown in FIGS. 1-3. The grader 10 includes a planar array of grading rollers 12 separated across gaps 14. The array of rollers defines a grading section 16 of the grader. In this example, the grading section has five cylindrical rollers, all of the same diameter. But more or fewer rollers could be used to match the throughput requirement. The grading section extends in length in the axial direction of the rollers 12 from an infeed end 18 to an opposite exit end 19 and laterally in width from a first side 20 more or less at the outer side of one of the outermost rollers to a second side 21 at the outer side of the opposite outermost roller. Grading section 16 and all the other components of the grader are supported in a frame 22 having legs 24.

Figure 4:
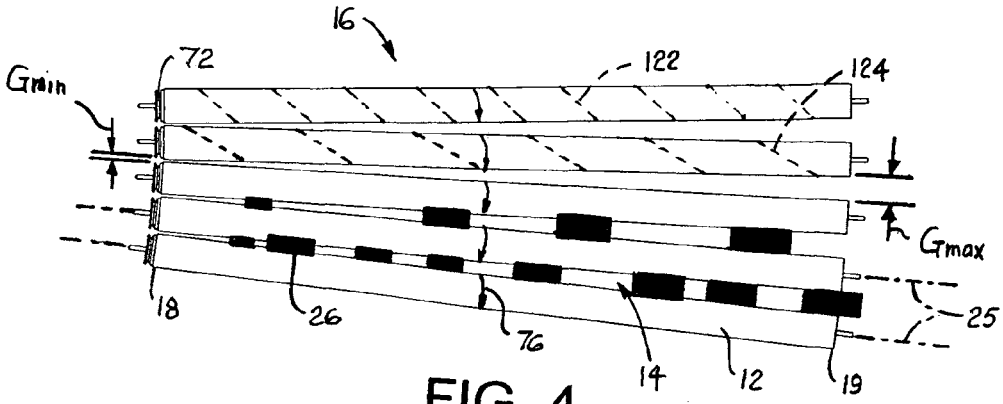
FIG. 4 is a top plan view of the array of rollers in the grader of FIG. 1.

As shown exaggerated in FIG. 4, the axes of rotation 25 of the rollers diverge from the infeed end 18 to the opposite end 19. The gaps 14 between laterally consecutive rollers 12 form gauging passages that increase in width from a minimum gauge $G_{min}$ at the infeed end 18 to a maximum gauge $G_{max}$ at the opposite exit end 19. In this case, the five grading rollers form four gauging passages. Products 26 fed into the grading section 16 advance along its length in the gaps. When a product advancing along the gap reaches a position along the widening gauging passage at which the passage width exceeds the lateral dimension of the product, the product falls through the passage under the influence of gravity. Thus, smaller products fall closer to the infeed end 18, and larger products, closer to the opposite end 19. Products whose lateral dimensions exceed the maximum gauge $G_{max}$ drop off the exit end 19 of the grader into a chute 28, as in FIGS. 1 and 3, for further processing.

Products to be graded are fed onto the grading section 16 at its upper infeed end 18 by a vibrating feed trough 30. The fan-shaped, corrugated feed trough has four widening feed channels 32 with triangular cross sections—each channel directing products to a corresponding one of the gauging passages 14 over an exit end 33 of the trough. The feed trough 30 is suspended from a feed framework 34 by four links 36 pivotally attached at both ends by pivot pins 37. An actuator, such as a crank mechanism having a motor 38 whose shaft rotates a crank arm 39 pivotally connected to one end of a connecting rod 40 whose opposite end is pivotally connected to a block 41 at the bottom of the feed trough 30, imparts a cyclic upthrusting and horizontal translation to the feed trough that impulsively advances products along the feed trough and helps unstack piggy-backed products. The cyclic upthrusting of the feed trough tosses the products upward above the bottoms of the feed channels, while the horizontal translation pulls the feed trough rearward so that the tossed products land farther down the feed channels. The combined motion of the feed trough advances the products along and unstacks piggy-backed products. Alternatively, a linear actuator connected between the grader frame and the bottom of the feed trough could be used. The downward slant of the trough also helps urge products onto the grading section 16 with the aid of gravity. Height restrictors 42 extending across the feed-trough channels 32 also serve as means for unstacking piggy-backed products advancing along the channels. The height restrictors could alternatively be rotatable with flaps or loops aligned with the feed channels and rotated opposite to the advance of products to knock piggy-backed products off lower products.

Figure 9:
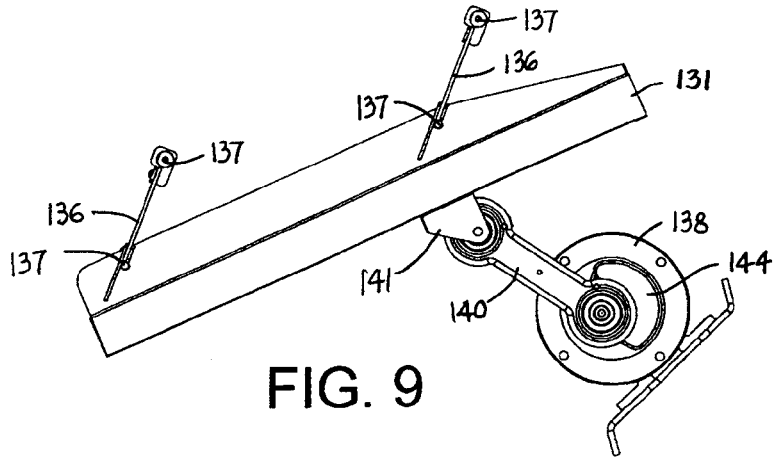
FIG. 9 is a side elevation view of another version of a feed trough usable in a grader as in FIG. 1.
Figure 10:
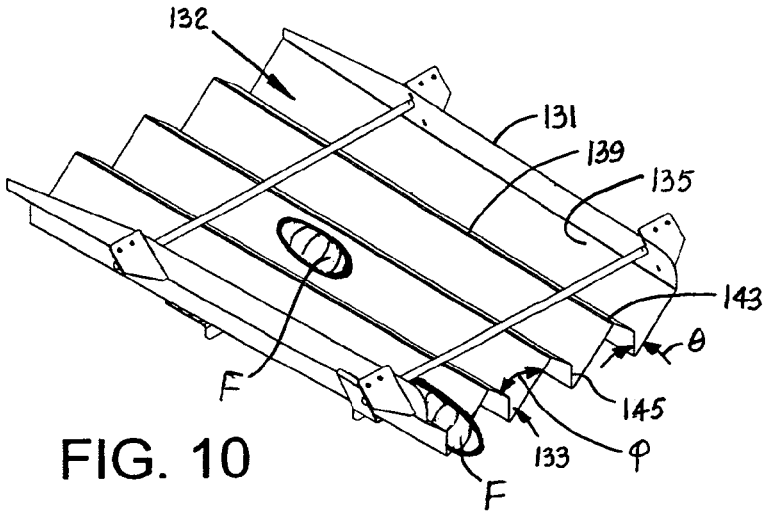
FIG. 10 is an isometric view of the feed trough of FIG. 9 showing the feed channels.

Another version of a vibrating feed trough is shown in FIGS. 9 and 10. The fan-shaped trough 131 shown has four widening feed channels 132. The cross section of the channels differs from the cross section of the triangular channels 32 in the feed trough 30 of FIG. 1 in that the angle θ at the bottom of the feed channels 132 is smaller in this version of the feed trough to form a narrow angled slot 133. The smaller angle θ of the slot is formed by a first channel wall 135 and a bottom portion 145 of a second channel wall 139. The channel walls converge and intersect at the bottom of the channel. A top portion 143 of the second channel wall bends away from the bottom portion 145 and meets the top of the first channel wall 135 of the adjacent channel. The plane of the top portion 143 of the second channel wall 139 forms an angle ϕ with the first channel wall 135. The top channel angle ϕ is greater than the bottom slot angle θ. Thus, each feed channel has a greater angle between the first and second side walls at the top of the channel than at the bottom. This channel configuration is especially useful in orienting chicken-wing flats (the section of the wing between the elbow and the flapper) on edge in the slots rather than resting on their broad sides spanning the first and second sides across the channel for better presentation to the grading rollers. A flat F dropped into one of the channels 132 generally lands with one of its broader sides on the first channel wall 135 or on the upper portion of the second channel wall 139. The vibration of the trough and gravity urge the flat into the slot 133 at the bottom of the channel. The narrowness of the slot relative to the dimensions of a flat F ensures that the flat orients on edge in the slot. Like the feed trough 30 of FIGS. 1-3, the feed trough 131 is actuated by a motor 138 whose shaft rotates a crank arm pivotally connected to one end of a connecting rod 140 whose opposite end is pivotally connected to a block 141 at the bottom of the feed trough 130. The feed trough is suspended from a feed framework by four links 136 pivotally attached at both ends by pivot pins 137. A counterweight 144 on the motor shaft balances the mass of the trough 130 to limit unwanted frame vibration that could damage the feed trough. The motion of the connecting rod imparts a cyclic upthrusting and horizontal translation to the feed trough that impulsively advances products along the declining feed trough and helps unstack piggy-backed products.

Graded products that pass through the gauging passages 14 drop onto the outer conveying surface 43 of a conveyor belt 44 disposed below the grading section 16 and running transverse to the length direction of the grading section. The conveyor belt is conventionally trained around drive and idle sprockets, drums, or pulleys (not shown) at each side of the grader. The sprockets, drums, or pulleys are rotated by a drive shaft 46 whose ends are supported in bearing blocks 48 attached to the frame 24 at each end 18, 19 of the grader. The drive shaft is coupled by a gear box 50 to a drive motor 52. As shown in FIG. 3, the conveyor belt 44 is mounted on a slant—parallel to the plane of the roller array—but it could also be oriented horizontally or at some other angle to the roller plane. Bars 54 serve as grade dividers that divide the conveying surface 43 of the belt into grading zones 56, 57 across the belt's width. In this example, smaller-grade products are conveyed in the leftmost zone 56 in FIG. 3 and larger-grade products, in rightmost zone 57. The largest-grade products fall off the end of the grading section into the chute 28. The grade dividers 54 may be positioned as desired along the length of the grading section with adjustment clamps 58 that can be loosened and moved along a support rod 60 to the desired position and tightened. In this way, the number and ranges of the grading zones are easily adjusted.

Figure 12:
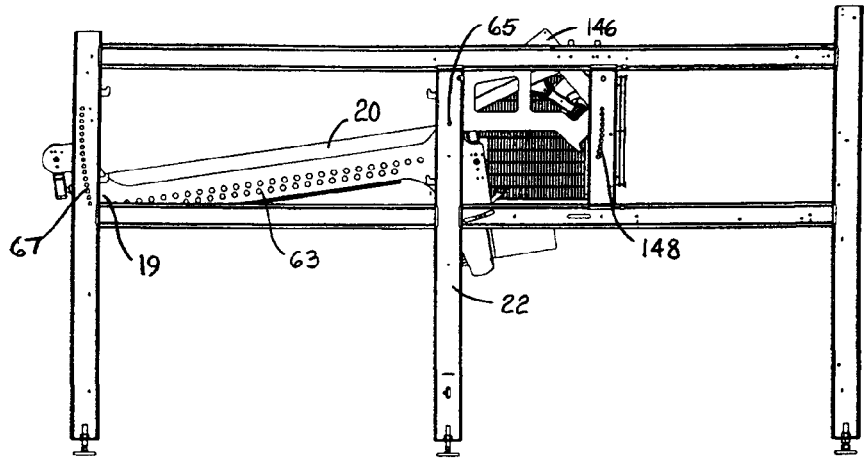
FIG. 12 is a side elevation view of a grader as in FIG. 1 showing a tilt mechanism for the feed trough and the grading section.
Figure 13:
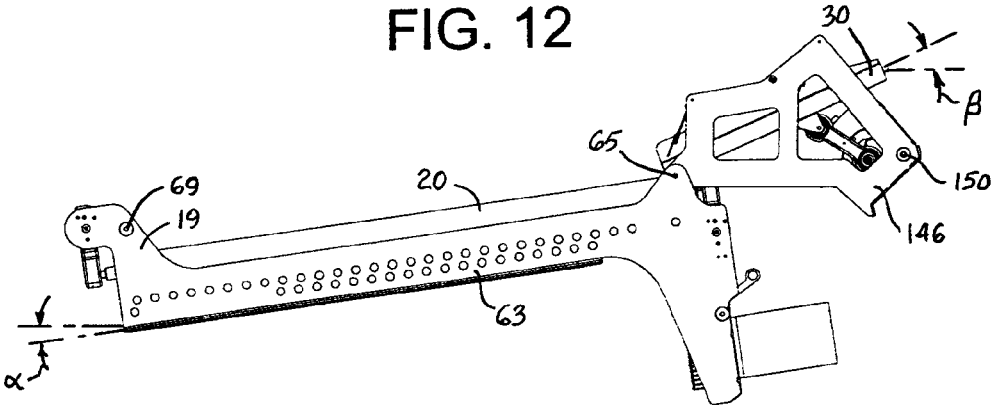
FIG. 13 is an enlarged side elevation view of the feed-trough portion of FIG. 12.

The grading section 16 is shown declining from the infeed end 18 to the opposite end 19 to allow gravity to help advance products along the grading section. The angle of declination a can be adjusted by, for example, adjusting the length of one pair of the legs 24, as indicated by two-headed arrow 62 in FIG. 3. Another way to adjust the angle of declination a of the grading section is shown in FIGS. 12 and 13. A grading-section frame 63 supporting the rollers 20 is pivotally attached at an upper end to the grader frame 22 by a pivot 65, such as a pin defining a horizontal axis about which the grading section can tilt. An arcuate row of holes 67 in the frame 22 provides fastening positions for the exit end 19 of the grading section. The angle of declination is adjusted by passing a bolt or pin through a selected one of the holes 67 and into a receptacle 69 in the roller frame 63. In a similar way, the declination angle β of the feed trough 131 can be adjusted. A feed-trough support frame 146 is pivotally connected to the grader frame 22 by the same pivot pin 65 as the grading-section frame 63. An arcuate row of holes 148 in the grader frame 22 is provided to admit a bolt or pin through a selected one of the holes 148 and into a receptacle 150 in the feed-trough frame 146. In this way, the angles of declination of the grader section and the feed trough can be independently adjusted without changing the drop-off point from the trough to the grading rollers. An overhead water spray 64 is provided by a pipe 66 with spray outlets 68 along its length. The spray, which is aimed at the grading section, helps lubricate the rollers 12 to prevent moist or sticky products from adhering to the rollers and not advancing.

Figure 11:
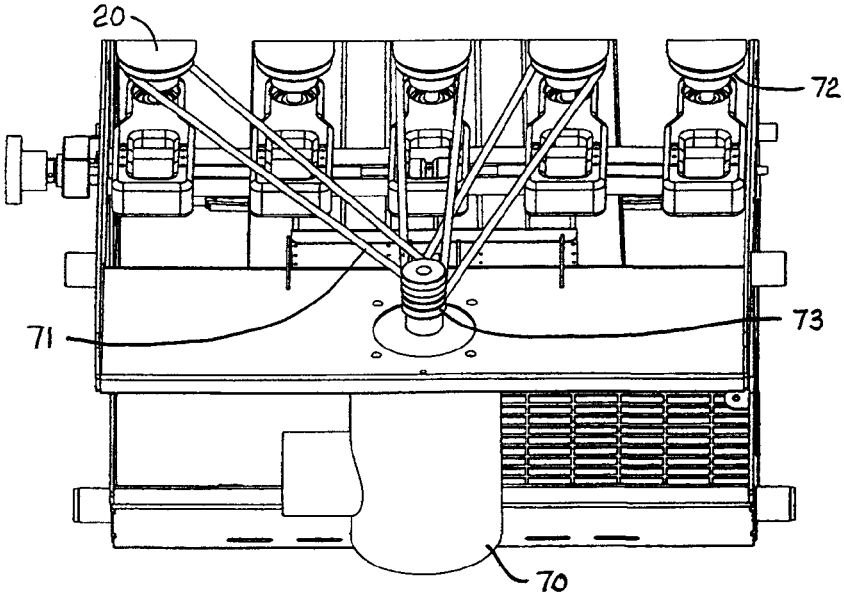
FIG. 11 is a view of the roller-drive system of the grader of FIG. 1.

The grading rollers 12 are rotated by a drive system that includes a drive motor 70 mounted to the frame 24 at the infeed end 18 of the grader. Transmission drive belts 71, as shown in FIG. 11, are trained around ganged pulleys 73 on the motor's drive shaft and individual pulleys 72 on the infeed ends of the grader rollers 12. (Only some of the transmission belts are shown in FIG. 11 to simplify the drawing.) The belts 73 can be, for example, twisted urethane belts, such as those sold by DuraBelt, Inc. of Hilliard, Ohio, U.S.A. As a safety measure, the belts slip on the motor pulleys when the rollers jam, such as when someone's hand catches in the rollers. Rotation of the motor rotates all the rollers in the same direction 76, as shown in FIG. 4. Because all the rollers rotate in the same direction and do not squeeze products through the intervening gaps, they allow all the gaps between consecutive grading rollers to be used as grading passages 14. In this way, more product can be graded in a smaller area, and throughput is greater than for graders with counter-rotating roller pairs. For example, a grader as in the invention with ten rollers has nine gauging passages compared to five for a grader with ten counter-rotating rollers grouped in five pairs.

As best shown in FIG. 2, the grading rollers 12 are suspended at the lower opposite end 19 from adjustment yokes 78 and supported from "upside down" adjustment yokes 78A at the infeed end 18. Because the rollers are supported in the top portions of the "upside down" yokes 78A at the infeed end and in the bottom portions of the "right-side up" yokes 78 at the opposite end 19, the yokes do not interfere with the feed trough at the infeed end or block product at the opposite end. The adjustment yokes at each end of the grading section are mounted on a lateral track 80 that includes a pair of lateral rails 82 flanking a rotatable threaded adjustment shaft 84. The minimum and maximum widths $G_{min}$ and $G_{max}$ of the gauging passages 14 are set by adjusting the lateral positions of the adjustment yokes at the infeed and opposite ends 18, 19 of the grading rollers.

Figure 5:
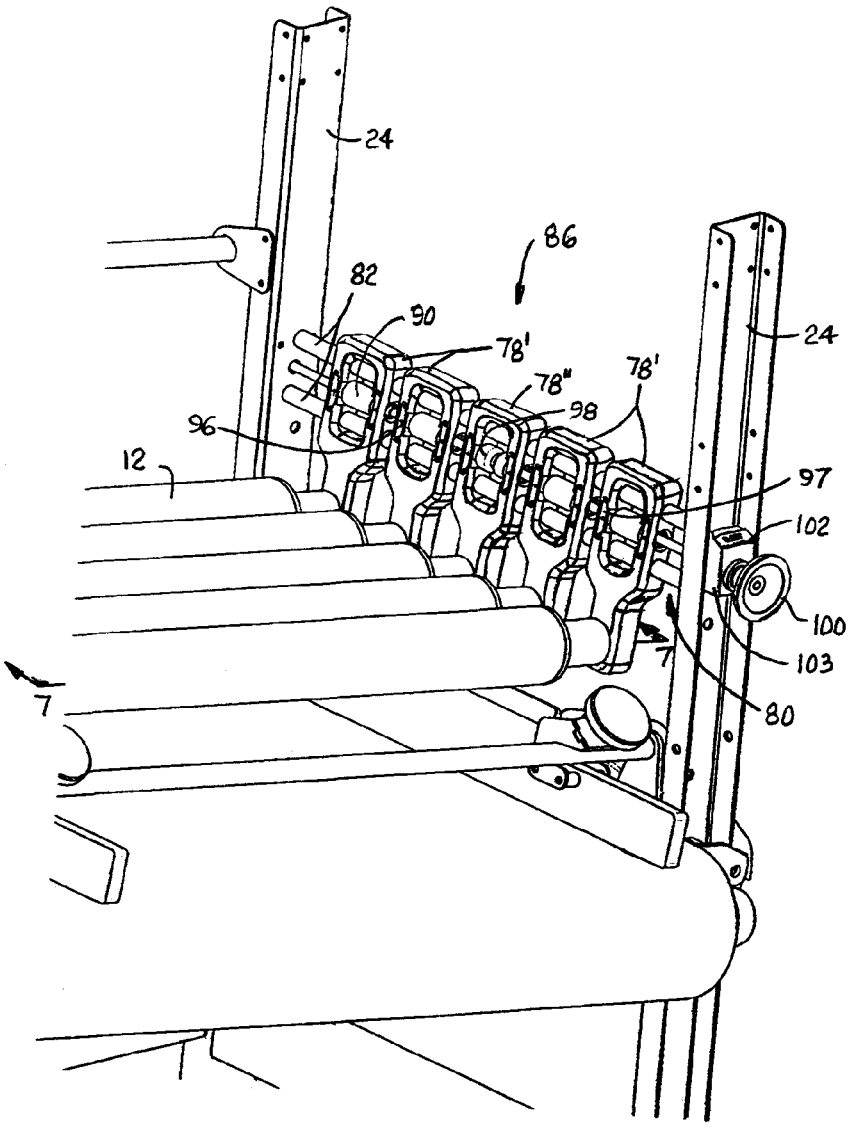
FIG. 5 is an enlarged view of the adjustable roller support at the exit end of the grader of FIG. 1.
Figure 6:
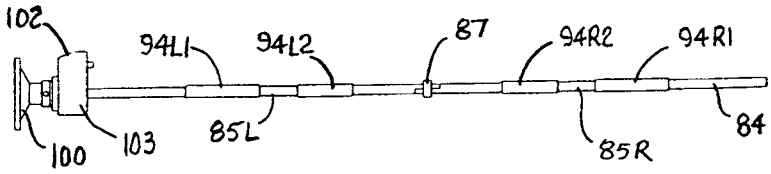
FIG. 6 is a side view of the threaded adjustment shaft of the grader of FIG. 1.

The adjustment yokes 78, the guide rails 82, and the rotatable shaft 84 are components of one means for adjusting the widths of the gauging passages 14 in unison. FIG. 5 shows the maximum-passage-width adjustment mechanism 86 at the exit end 19 of the grading section 16 in greater detail. (The minimum-passage-width adjustment mechanism at the infeed end 18 is similar in construction, except that the yokes are "upside down" with the lateral track below the connection to the rollers.) The passage-width adjustment mechanism 86 shown in FIG. 5 includes two movable adjustment yokes 78' flanking a central stationary yoke 78". All the yokes are supported on the guide rails 82, which are supported at each end by the legs 24 of the grader frame. The guide rails are received in holes 88 in the yokes. (See FIG. 7.) Another set of holes 89 in the yokes admits the rotatable adjustment shaft 84. Each of the movable yokes 78' includes a nut 90 in a central cavity 92. Internal threads on the nut 90 engage threads on the rotatable shaft. As shown in FIG. 6, the shaft 84 has two mirror-image halves 85L and 85R joined by a collar 87. Four threaded sections 94L1, 94L2, 94R2, 94R1 are formed on the shaft at fixed locations. Each of the four nuts 90 is confined to one of the four threaded sections. The outermost threaded sections 94L1 and 94R1 are threaded oppositely—one with left-handed threads, the other with right-handed threads. The thread pitch is the same for both outer threaded sections 94L1 and 94R1. The interior threaded sections 94L2 and 94R2 are also threaded opposite to each other and have the same thread pitch. But the thread pitch of the inner threaded sections 94L2 and 94R2 is less than that of the outermost sections 94L1 and 94R1, for example, 0.05 in/thread versus 0.1 in/thread. In the example of FIG. 5, with five grading rollers 12, the thread pitch of the inner threaded sections is half that of the outer threaded sections so that the nuts 90 in the outermost adjustment yokes 78' translate laterally along their tracks twice as far as the nuts in the inner movable yokes 78' as the adjustment shaft 84 is rotated. This is necessary because each roller must be moved laterally a distance corresponding to the sum of all the widths of the grading gaps between itself and the central roller supported by the stationary yoke 78". And the outer threaded sections can be made longer than the inner to provide a proportionally greater lateral adjustment range. Because the threaded sections on one half of the shaft 84 have the opposite handedness of the threaded sections on the other half, the nuts on opposite halves move laterally in opposite directions as the shaft is rotated. Thus, the passage-width adjustment mechanism at each end of the grader rollers translates the ends of the rollers laterally in unison to change the gap width of all the gauging passages at each end at the same rate. In this way, all the passages have the same width at all times. And because each movable yoke advances along only one threaded section on the shaft, the precision of the positioning of the yoke on the shaft and the widths of the associated grading gaps is affected only by the minute amount of play between the threads of the threaded section and the nut.

Because the nuts 90 are captured in the central cavities 92 of the movable yokes 78', the yokes translate laterally along the track 80 with the nuts. To ensure accurate gap widths despite the inevitable slight misalignment of the rollers with respect to the shaft 84, the nuts 90 have to be fixed laterally at an initially calibrated position within the movable yokes 78' relative to the rollers. During calibration, set screws 96 that engage the ends of the nut through screw plates 97 at both ends of each yoke to immobilize the nut are loosened to allow the nut to be moved along its threaded section of the shaft. With the set screws loosened, the rollers are manually adjusted to a given gap width by manually rotating the loosened nuts to translate the yokes along the shaft as required for the desired roller positioning. Once all the rollers are in position, the set screws are tightened to lock and immobilize the nuts in place within the yokes for regular operation. Instead of nuts, the central stationary yoke 78" has a pair of bushings 98 that admit an unthreaded portion of the shaft 84 and allow it to rotate within the stationary yoke 78". Like the nuts 90 in the movable yoke 78', the bushings 98 in the stationary yoke 78" are held in position by set screws 96. The adjustment shaft 84 is rotated by an adjustment wheel 100 at one end. The shaft is also optionally outfitted with a display 102 that indicates the gap-width setting at that end of the grader. The display is coupled to a rotation counter 103. Means for limiting the range of motion of each yoke may be used to ensure that each nut is confined to its corresponding threaded section. Furthermore, the gap-adjustment mechanism can be automated by replacing the wheel with a motor to rotate the adjustment shaft, by using a rotation counter that provides a signal indicating shaft rotation corresponding to gap width, and by routing the signal to a controller for displaying the gap width on a monitor or computing motor-control signals to rotate the adjustment shaft to provide a selected gap width.

Figure 7:
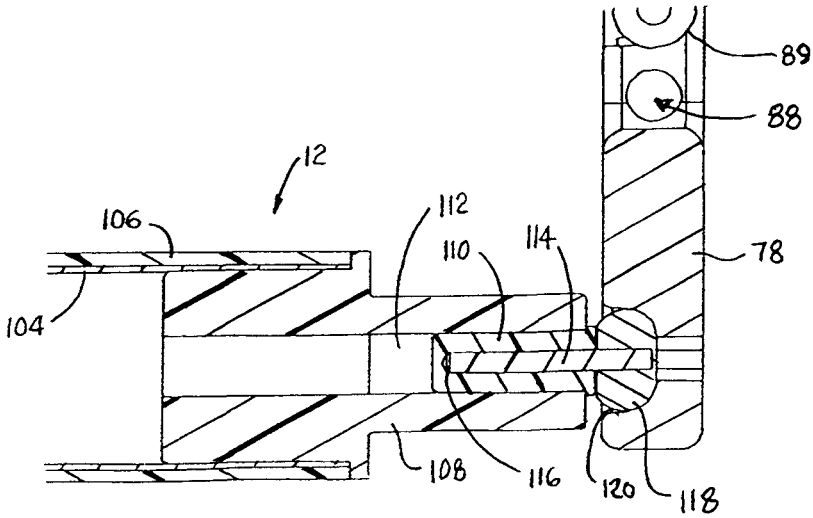
FIG. 7 is a cross section of the end of one of the rollers showing its engagement with an adjustable roller yoke taken along line 7-7 of FIG. 5.
Figure 14:
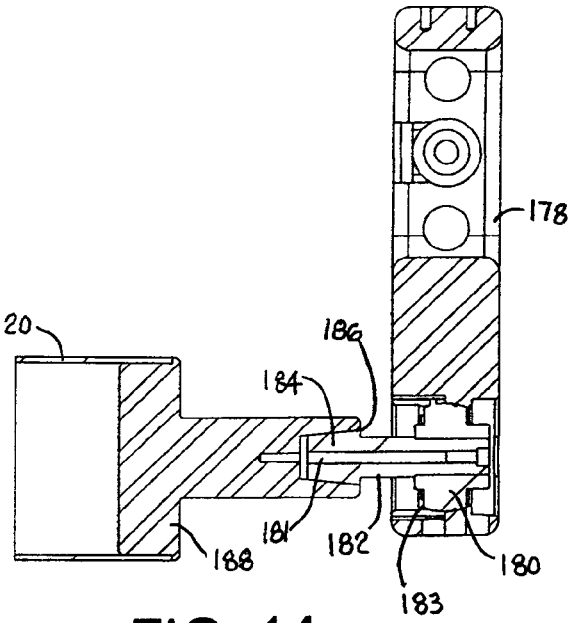
FIG. 14 is a cross section view of another version of the connection between a roller and a yoke usable in the grader of FIG. 1.

The grader rollers 12 are constructed and connected to the yokes 78 as shown in FIG. 7. Each roller includes a stainless steel pipe 104 coated with a plastic or rubber coating 106 and capped at each end by a stainless steel or plastic end plug 108. A low-friction bushing 110 is press-fitted in a bore 112 in the end plug. The bushing receives an end of a pin 114 in the bushing's central bore 116. The roller 12 rotates on the pin. The other end of the pin 114 is press-fitted in a ball joint 118 residing in a recess 120 in the adjustment yoke 78. The ball joint allows the pin's axis to pivot to align with the roller's axis for all positions of the adjustment yoke along its lateral adjustment range. In another version of the yoke 178, as shown in FIG. 14, a bearing 180 receives a pivot pin 181. The bearing pivotally resides in a recess 183 in the yoke. A bushing 182 surrounding the pivot pin has a frustoconical head 184 received in a cavity 186 in an end plug 186 of the roller 20 for precise, centered alignment. The pivotable bearing allows the pin's axis to align with the roller's axis for all positions of the adjustment yoke 178 along its lateral adjustment range.

As shown in FIG. 4, the rollers 12 are optionally equipped with helical ridges 122, 124 on their peripheries to help push products along the grading section 16. The ridges can be formed by wires wrapped helically around the peripheries of the rollers. To help align the products better in the grading gaps 14 and to separate piggy-backed products, the helical ridges of adjacent rows can have different pitches to jostle the products as they advance along the rollers. As one example, the helical pitches of the ridges can alternate from roller to roller across the roller array.

Figure 8:
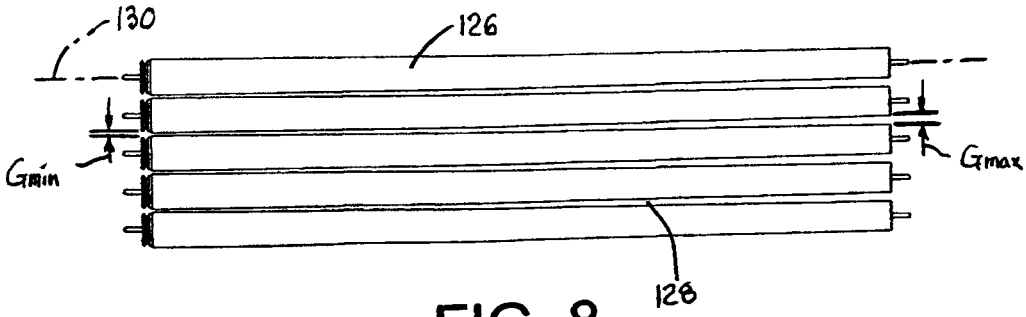
FIG. 8 is a top plan view of another version of a roller arrangement using parallel, tapered rollers in a grader as in FIG. 1.

Another version of a roller arrangement is shown in FIG. 8. In this version, each roller 126 is tapered; i.e., its diameter decreases continuously from the infeed end 18 to the opposite end 19. Thus, the width $G_{min}$ of the gauging passage 128 at the infeed end is less than the width $G_{max}$ at the opposite end. But even if half the rollers have the same constant diameter and the other half are tapered and alternated with the constant-diameter rollers, a widening gauging passage is formed between consecutive rollers. And rollers stepped in diameter, rather than tapered, could be used to widen the gauging passages. In this version, the roller axes 130 are shown in parallel, but they could alternatively be connected to passage-width adjustment mechanisms as in FIG. 5 to provide a range of adjustment.

Although the invention has been described in detail with reference to a few exemplary versions, other versions are possible. For example, more than five rollers, which provide four gauging passages, could be used to increase capacity. And, although the particular grader described has an odd number of rollers, including the central one supported by a stationary yoke, an even number of rollers, all supported on movable yokes, could be used. Furthermore, the stationary yoke could be used to support any one of the rollers—for example, one of the outermost rollers. In that case, all the threaded sections on the adjustment shaft would be threaded in the same direction, but the opposite outermost roller would have to be associated with an especially long threaded section to account for all the gap widths accumulated across the width of the grading section. So, as these few examples suggest, the scope of the claims is not meant to be limited to the versions described in detail.

What is claimed is:

1. A grader comprising:

a grading section extending in length from an infeed end to an opposite end and in width from a first side to a second side and having gauging passages spaced apart across the width and extending along the length of the grading section;

a feed trough including a plurality of feed channels, each feed channel having an exit end disposed above and aligned with a corresponding one of the gauging passages to drop products to be graded into the corresponding gauging passage at the infeed end of the grading section; and a pivot defining a horizontal axis about which the feed trough and the grading section are independently tiltable to adjust their declination angles.

2. A grader as in claim 1 wherein the grading section includes:

a plurality of rollers having axes of rotation directed from the infeed end to the opposite end and spaced apart laterally across the width of the grading section to define gauging passages extending along the length of the grading section between laterally consecutive rollers; and a drive system coupled to the plurality of rollers to rotate all the rollers in the same direction on their axes.

3. A grader as in claim 1 further comprising a height restrictor extending across the width of the feed trough above the feed channels for unstacking piggy-backed products.

4. A grader as in claim 1 further comprising an actuator attached to the feed trough to impart to the feed trough a cyclic upthrusting motion and a cyclic translating motion toward and away from the grading section to toss the products to be graded upward above the feed channels while the translating motion is drawing the feed trough rearward so that the tossed products land farther along the feed channels closer to the exit end.

5. A grader as in claim 1 wherein each of the feed channels of the feed trough is formed by first and second walls converging to an intersection at the bottom of the feed channel.

6. A grader as in claim 5 wherein a first angle between the first and second walls in a top portion of the feed channel is greater than a second angle between the first and second walls in a bottom portion of the feed channel.

7. A grader comprising:

a grading section extending in length from an infeed end to an opposite end and in width from a first side to a second side and having gauging passages spaced apart across the width and extending along the length of the grading section;

a feed trough including a plurality of feed channels, each feed channel having an exit end disposed above and aligned with a corresponding one of the gauging passages to drop products to be graded into the corresponding gauging passage at the infeed end of the grading section;

an actuator attached to the feed trough to impart to the feed trough a cyclic upthrusting motion and a cyclic translating motion toward and away from the grading section to toss the products to be graded upward above the feed channels while the translating motion is drawing the feed trough rearward so that the tossed products land farther along the feed channels closer to the exit end; and a pivot defining a horizontal axis about which the feed trough and the grading section are pivotable.

8. A grader as in claim 7 further comprising a pivot defining a horizontal axis about which the feed trough and the grading section are independently tiltable to adjust their declination angles.

9. A grader as in claim 7 wherein the actuator comprises a crank mechanism including:

a motor having a shaft;

a connecting rod pivotally attached at one end to the feed tank;

a crank arm rotated by the shaft of the motor and pivotally connected to the other end of the connecting rod.

10. A grader as in claim 9 further comprising a counterweight on the shaft of the motor to balance the mass of the feed trough and limit vibration of the feed trough.

11. A grader as in claim 7 wherein the grading section includes:

a plurality of rollers having axes of rotation directed from the infeed end to the opposite end and spaced apart laterally across the width of the grading section to define gauging passages extending along the length of the grading section between laterally consecutive rollers; and a drive system coupled to the plurality of rollers to rotate all the rollers in the same direction on their axes.

12. A grader comprising:

a grading section extending in length from an infeed end to an opposite end and in width from a first side to a second side and having gauging passages spaced apart across the width and extending along the length of the grading section;

a feed trough including a plurality of feed channels, each feed channel having an exit end disposed above and aligned with a corresponding one of the gauging passages to drop products to be graded into the corresponding gauging passage at the infeed end of the grading section;

wherein each of the feed channels of the feed trough is formed by first and second walls converging to an intersection at the bottom of the feed channel and wherein a first angle between the first and second walls in a top portion of the feed channel is greater than a second angle between the first and second walls in a bottom portion of the feed channel.

13. A grader as in claim 12 wherein each of the feed channels of the feed trough is formed by first and second walls converging to an intersection at the bottom of the feed channel and wherein a first angle between the first and second walls in a top portion of the feed channel is greater than a second angle between the first and second walls in a bottom portion of the feed channel.

14. A grader as in claim 12 wherein the grading section includes:

a plurality of rollers having axes of rotation directed from the infeed end to the opposite end and spaced apart laterally across the width of the grading section to define gauging passages extending along the length of the grading section between laterally consecutive rollers; and a drive system coupled to the plurality of rollers to rotate all the rollers in the same direction on their axes.

* * * * *